US005450991A

United States Patent [19]

Neading

[11] Patent Number: 5,450,991

[45] Date of Patent: Sep. 19, 1995

[54] COMBINATION STORAGE BELT AND SKI CARRIER ACCESSORY AND METHOD OF CONVERSION

[76] Inventor: Ryan R. Neading, 24255 Pacific Coast Hwy., #1351, Malibu, Calif. 90263

[21] Appl. No.: 201,627

[22] Filed: Feb. 25, 1994

[51] Int. Cl.[6] ..... A45F 3/14

[52] U.S. Cl. ..... 224/151; 224/205; 224/224; 224/250; 224/257; 224/917; 280/814; 294/141; 294/147; 294/157

[58] Field of Search ..... 224/151, 153, 202, 205, 224/224, 226, 250, 257, 258, 917; 280/814; 294/141–143, 146, 147, 157

[56] References Cited

U.S. PATENT DOCUMENTS

| | | | |
|---|---|---|---|
| 2,530,695 | 11/1950 | Helmert | 224/151 |
| 3,920,166 | 11/1975 | Hogensen, Jr. | 224/151 |
| 4,460,207 | 7/1984 | Gies | 294/147 |
| 4,515,300 | 5/1985 | Cohen | 224/151 |
| 4,630,842 | 12/1986 | Roda | 280/814 |
| 4,810,102 | 3/1989 | Norton | 224/151 X |
| 4,842,315 | 6/1989 | Nordmeyer | 294/147 |
| 4,863,083 | 9/1989 | Chen | 224/226 |
| 4,889,364 | 12/1989 | Glaunes | 280/814 |
| 4,903,875 | 2/1990 | Smart et al. | 224/258 |
| 5,160,074 | 11/1992 | Coates | 224/257 |
| 5,318,084 | 6/1994 | Jackson | 224/151 X |
| 5,335,835 | 8/1994 | Hogan | 225/257 |

FOREIGN PATENT DOCUMENTS

| | | | |
|---|---|---|---|
| 2577123 | 8/1986 | France | 294/147 |
| 3128920 | 2/1983 | Germany | 224/257 |

*Primary Examiner*—J. Casimer Jacyna
*Attorney, Agent, or Firm*—John R. Flanagan

[57] ABSTRACT

A combination storage belt and ski carrier accessory includes a belt mounting a pair of releasably and reversably attachable flexible members at each of a pair of opposite ends of the belt and a storage bag at an intermediate location thereon between the opposite ends of the belt. The belt is adjustable to convert it between a contracted condition and an expanded condition. In the contracted condition, the adjustable belt is adapted to be worn about a user's waist with the flexible members forming closed loops positioned on the same side of the belt as the storage bag. In the expanded condition, the belt is adapted to be worn across the front of the user's torso and over one shoulder with the flexible members forming closed loops positioned on the opposite side of the belt from the storage bag to hold and carry skis in a generally upright orientation along the user's back. The storage bag is accessible both when the belt is worn around waist and when worn across the torso to carry skis. The accessory also has connector members attached to opposite ends of the belt which are connected to one another when the belt is worn around the waist and disconnected from one another when the belt is worn across the front of the user's torso and over one shoulder.

15 Claims, 2 Drawing Sheets

COMBINATION STORAGE BELT AND SKI CARRIER ACCESSORY AND METHOD OF CONVERSION

BACKGROUND OF THE INVENTION

1. Field of the Invention

The present invention generally relates to devices for carrying skis and, more particularly, is concerned with a combination storage belt and ski carrier accessory which mounts a storage bag so that it is accessible both when the accessory is normally worn around the waist of a user and after conversion when the accessory is worn across or along the front of the torso and over one shoulder of the user to carry a pair of skis across or along the back of the user.

2. Description of the Prior Art

Snow skiing, both downhill and cross-country, is a winter sport continuing to increase in popularity. As is well-known, snow skiing requires specialized equipment. Basically, the skier must have ski boots, a pair of skis, and a pair of poles. Transporting this equipment can be quite cumbersome, especially carrying long skis and poles while walking around the ski site when not actually skiing. Traditionally, skiers have placed the skis together upon their shoulders so that the skis extend in a generally fore-and-aft horizontal orientation. However, this makes an unwieldly dangerous load which is difficult for some skiers to balance and presents a potential source of injury to others.

In an effort to reduce the problems and hazards which may arise when carrying two long skis and two ski poles, various types of ski carriers have been proposed heretofore in the prior art. One type of ski carrier attaches around the skis and provides a handle to permit the skis to be carried as one would carry a suitcase. Ski carriers of this type are disclosed in U.S. patents to Warner (U.S. Pat. No. 3,892,343), Moudry et al (U.S. Pat. No. 3,976,234), Camelio (U.S. Pat. No. 4,043,493), Koepcke (U.S. Pat. No. 4,059,208), Lafreniere et al (U.S. Pat. No. 4,274,571), Sauzay (U.S. Pat. No. 4,427,217), Gies (U.S. Pat. No. 4,460,207), Nordmeyer (U.S. Pat. No. 4,842,315) and Glaunes (U.S. Pat. No. 4,889,364).

Another type of ski carrier attaches to the rear or lower ends of the pair of skis and provides a carriage to permit rolling the skis by pushing or pulling them while being held in a generally upright position. A ski carrier of this type is disclosed in U.S. Pat. No. 3,861,701 to Aring et al.

A further type of ski carrier is a belt worn about the waist of the skier and being provided with fastening devices for hanging the skis and boots from the belt. The skis can be held in a vertical orientation alongside the skier. A ski carrier of this type is disclosed in U.S. Pat. No. 4,863,083 to Chen.

Still another type of ski carrier is a sling-like carrying strap attached about the skis and capable of being gripped and carried like a suitcase or placed over the shoulder in a sling fashion. Ski carriers of this type are disclosed in U.S. patents to Westerholm (U.S. Pat. No. 4,002,277), Baker (U.S. Pat. No. 4,221,314), Nalvarian (U.S. Pat. No. 4,234,113), Saka (U.S. Pat. No. 4,456,284), Smart et al (U.S. Pat. No. 4,903,875) and Coates (U.S. Pat. No. 5,160,074).

The ski carriers of this latter type appear to constitute a step in the right direction compared to the other types of ski carriers in that most latter type ski carriers allow the skis to be carried in an upright or vertical position where they are easier to control and less likely to interfere with others. However, these ski carriers must be stowed somewhere when not being used, such as in a backpack or similar carrying bag, or put in a locker or other secure place. For that reason, these devices are not found in widespread use up to the present time.

Consequently, a need still exists for a carrier device which will overcome the drawbacks of the prior ski carriers.

SUMMARY OF THE INVENTION

The present invention provides a combination storage belt and ski carrier accessory and a method of conversion designed to satisfy the aforementioned needs. The combination or dual use accessory of the present invention mounts a storage bag which is accessible for use while the accessory is normally being worn around the waist of a user and also after the accessory is converted for wearing across or along the front of the user's torso and over one of the user's shoulders to carry skis across or along the back of the user' torso. The accessory of the present invention modifies and transforms a type of storage bag mounted on a waist belt (commonly referred to as a "fanny pack") which is very popular and widely used by skiers into a ski carrier by modifying the waist belt so as to be able to lengthen it and by attaching pairs of reversably securable straps to respective opposite ends of the belt. The dual use capability incorporated by the accessory eliminates the need to find a place to stow the ski carrier when not in use.

Accordingly, the present invention is directed to a combination storage belt and ski carrier accessory which comprises: (a) an elongated belt having connector members mounted to a pair of opposite ends of the belt, the connector members being connectable to and disconnectable; (b) a pair of flexible members attached to the belt adjacent to each of the opposite ends thereof, the flexible members of each pair thereof being releasably and feversably attachable to one another to form closed loops disposed on either one or the other of a pair of opposite side of the belt; and (c) a storage bag attached to the belt on one of the opposite sides thereof at an intermediate location spaced from the opposite ends of the belt.

The belt is adjustable to convert it between a contracted condition and an expanded condition such that the length of the belt is greater in the expanded condition than in the contracted condition. In the contracted condition, the belt is adapted to be worn about the waist of a user with its connector members connected to one another and the closed loops formed by the releasably and reversably attachable flexible members being positioned on the same one side of the belt as the storage bag. In the expanded condition, the belt is adapted to be worn across the front of the torso and over one shoulder of the user with its connector members disconnected from one another and the closed loops formed by the releasably and reversably attachable flexible members being positioned on the opposite side of the belt from the storage bag to hold and carry the skis in a generally upright orientation along the user's back.

The storage bag is accessible both when the belt is worn around waist and when worn across the front of the torso to carry the skis. After being adjusted to the expanded condition, the intermediate portion of the belt with the storage bag attached thereto are disposed across the front of the user's torso so as to still provide convenient access by the user to the storage bag.

The present invention also is directed to a method of converting an accessory between a single use storage belt mode and a dual use storage belt and ski carrier mode. The accessory converting method comprises the steps of: (a) providing an elongated belt having a pair of connector members mounted to a pair of opposite ends of the belt and a storage bag attached to the belt at an intermediate location spaced from the opposite ends of the belt and on one of a pair of opposite sides of the belt; and (b) adjusting the belt to convert it from a contracted condition wherein the belt is adapted to be worn about the waist of a user with its connector members connected to one another, to an expanded condition wherein the adjustable belt is adapted to be worn across the front of the torso and over the shoulder of the user with its connector members disconnected from one another to carry skis in a generally upright orientation along the user's back.

The method also comprises the step of providing a pair of flexible members attached to the belt adjacent to each of the respective opposite ends thereof, the flexible members of each pair thereof being releasably and reversably attachable to one another to form closed loops disposed on either one or the other of the pair of opposite side of the belt. The method further comprises the steps of: attaching with one another the straps of each pair thereof to form a closed loop on the same one of the pair of opposite sides of the belt as the storage bag in converting the belt to the contracted condition in which the belt is adapted to be worn about the waist of the user; and attaching with one another the straps of each pair thereof to form a closed loop on the opposite one of the pair of opposite sides of the belt from the storage bag in converting the belt to the expanded condition in which the belt is adapted to be worn across the front of the torso and over the shoulder of the user to carry skis in the generally upright orientation along the user's back.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
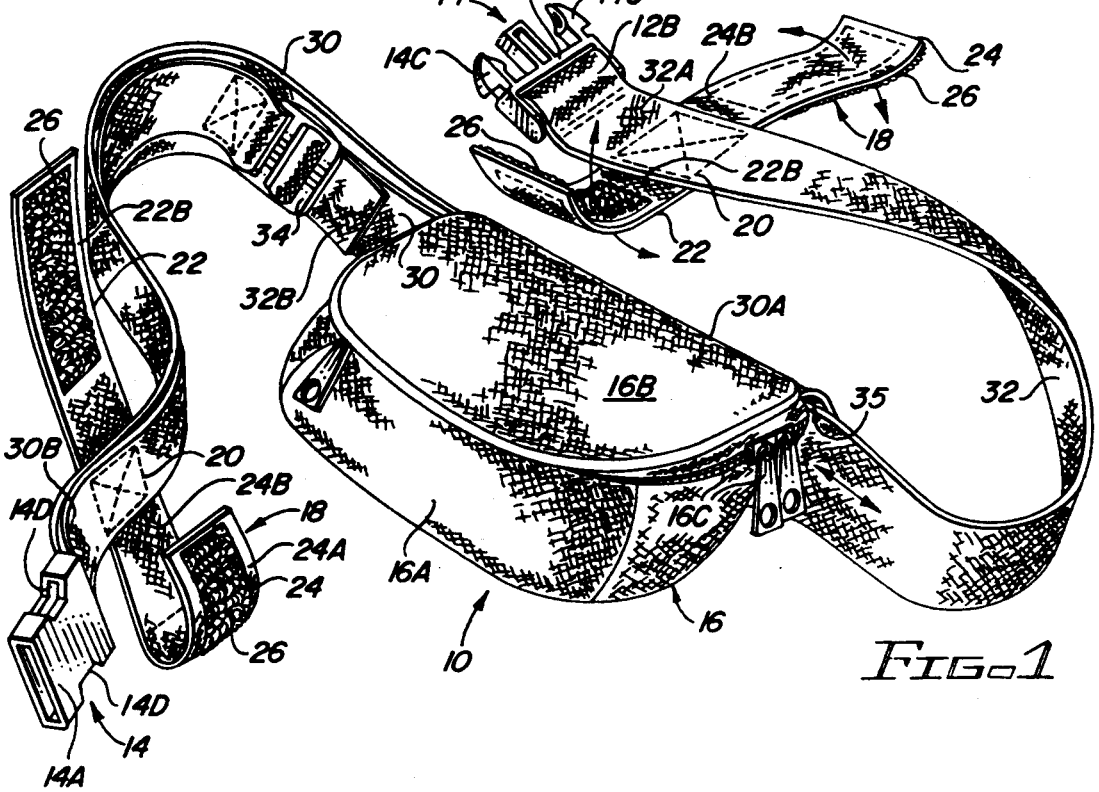
FIG. 1 is a perspective a combination storage belt and ski carrier accessory of the present invention.

Referring to the drawings, and particularly to FIG. 1, there is illustrated a combination storage belt and ski carrier accessory, generally designated 10, being constructed and convertible between dual uses in accordance with the present invention. Hereinafter, for the sake of brevity, the combination storage belt and ski carrier accessory 10 will simply be referred to as the accessory 10.

Referring again to FIG. 1, the accessory 10 basically includes an elongated flexible belt 12 being adjustable in length, a releasable securing means 14, a storage bag 16 and a releasable and reversable securing means 18. The releasable securing means 14 preferably takes the form of a pair of matable connector members 14A, 14B each mounted to one of a pair of opposite ends 12A, 12B of the belt 12. The connector members 14A, 14B per se have a known design. One connector member 14A has a pair of resiliently yieldable opposing latch fingers 14C being depressible manually in a known manner toward one another to insert past and latch into a pair of opposing notches 14D defined in the other connector member 14B. In such manner, the connector members 14A, 14B can be interfitted and connected to one another (as seen in FIGS. 2 and 3) or withdrawn and disconnected from one another (as seen in FIGS. 1, 4 and 5).

The storage bag 16 is fixedly attached to the elongated belt 12 on one side 12C of a pair of opposite surfaces or sides 12C, 12D of the belt 12 and at an intermediate location therealong being spaced from the opposite ends 12A, 12B of the belt 12. The storage bag 16 per se has a known design with a body portion 16A and a lid portion 16B being openable and closable relative to the body portion 16A by operation of a conventional zipper 16C.

The releasable supporting means 18 preferably is in the form of a pair of straps 18 extending in crossing transverse relationship to the belt 12 and being fixedly attached, such as by stitching 20 or other suitable means, at midsections 18A of the straps 18 to the belt 12 adjacent to respective opposite ends 12A, 12B thereof. Each strap 18 defines a pair of flexible members 22, 24 extending in opposite directions away from the belt 12. The flexible members 22, 24 of each pair thereof have fastening means 26 secured to opposite ones 22B, 24A of a pair of opposite surfaces 22A, 22B and 24A, 24B of each flexible member 22, 24. Preferably, the fastening means 26 takes the form of complementary hook and loop fastening materials, such as commercially known by the trademark VELCRO. Due to such arrangement of fastening means 26 on the opposite ones 22B, 24A of the surfaces 22A, 22B and 24A, 24B thereof, the flexible members 22, 24 are releasably and reversably attachable to one another to form a closed loop 28 disposed on either one or the other of the pair of opposite sides 12C, 12D of the belt 12, as seen in FIGS. 2 and 4.

Figure 6:
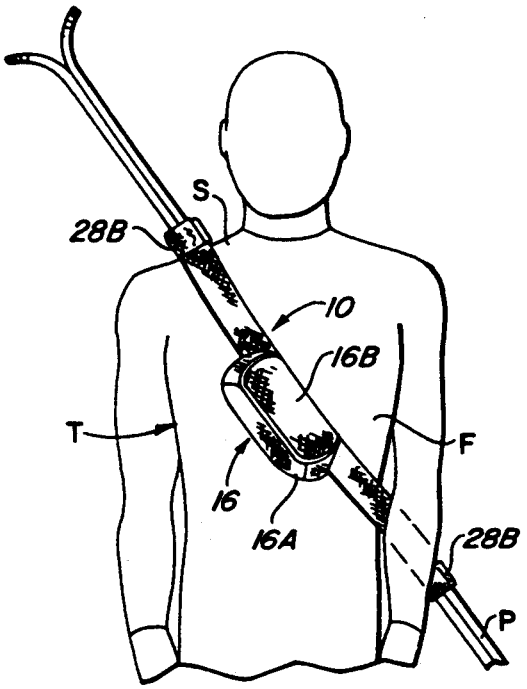
FIG. 6 is a front view of a user with the accessory converted into a dual use storage belt and ski carrier mode showing the belt and storage bag disposed across the front of the user's torso.
Figure 7:
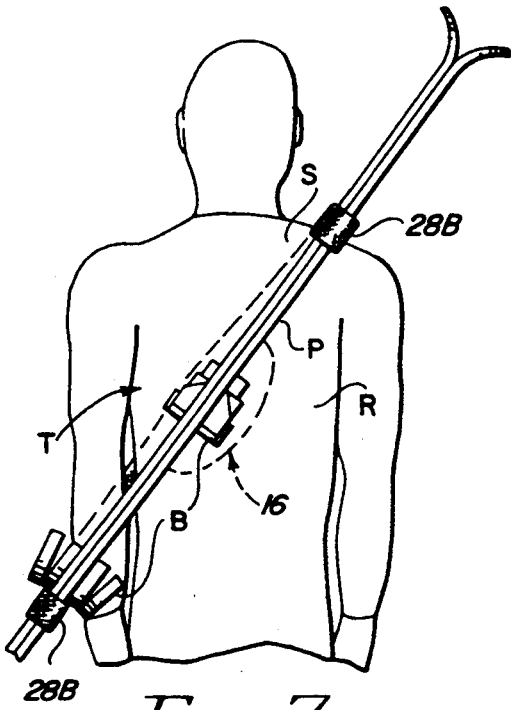
FIG. 7 is a rear view of a user with the accessory converted into the dual use storage belt and ski carrier mode showing the skis carried across the back of the user's torso.
Figures 2, 3, 4, 4A, 5:
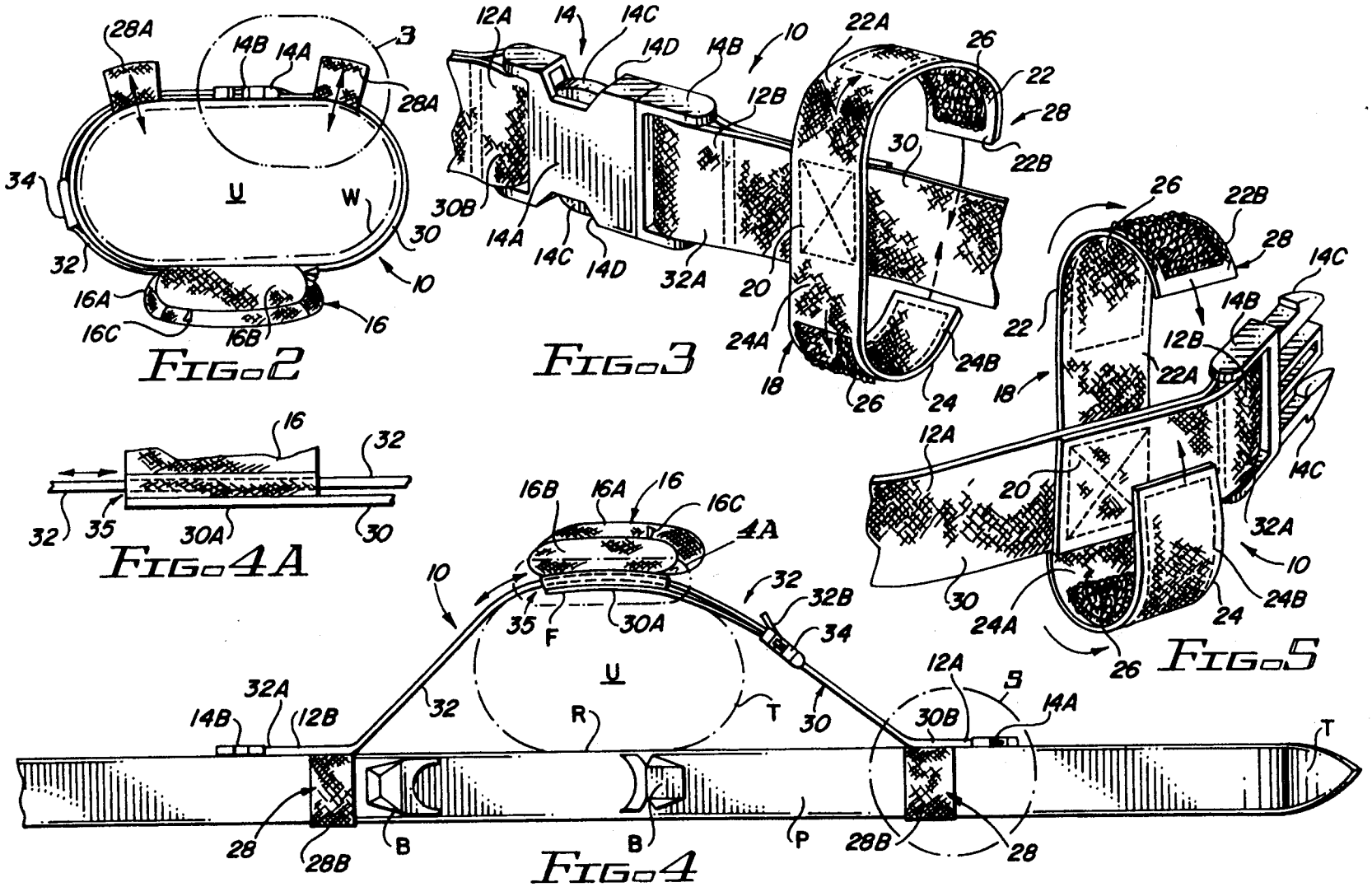
FIG. 2 is a top plan view of the accessory in a single use storage belt mode wherein the belt of the accessory is worn around the waist of a user.
FIG. 3 is an enlarged detailed perspective view of the portion of the accessory enclosed by the oval 3 in FIG. 2.
FIG. 4 is a top plan view of the accessory converted into a dual use storage belt and ski carrier mode wherein the belt of the accessory is worn across the front of the user's torso and over one of the user's shoulders and the skis are carried generally upright across the back thereof.
FIG. 4A is an enlarged detailed plan view of the portion of the accessory enclosed by the oval 4A in FIG. 4.
FIG. 5 is an enlarged detailed perspective view of the portion of the accessory enclosed by the circle 5 in FIG. 4.

Referring to FIGS. 2–5, the flexible belt 12 includes a main strap portion 30, an adjustment strap portion 32 and an adjustment buckle 34. The main strap portion 30 is fixedly attached along one end 30A to the back side of the storage bag 16 so as to define a passage 35 extending therebetween and is secured at an opposite end 30B to the one connector member 14A. The adjustment strap portion 32 is secured at one end 32A to the other connector member 14B and slidably mounted through the passage 35 between the back side of the storage bag 16 and the one end 30A of the main strap 30. The adjustment buckle 34 is secured to the main strap portion 30 intermediate the opposite ends 30A, 30B thereof and is adjustably coupled to the free end 32B of the adjustment strap portion 32 to adjustably couple the latter to the main strap portion 30 so as to allow adjustment of the overall length of the belt 12. The length of the belt 12 typically will need to be adjusted to fit it about users having waists of different sizes. However, the length of the belt 12 is also adjusted by a certain amount in converting the belt 12 between a contracted condition seen in FIG. 2, and an expanded condition seen in FIG. 4. Usually, the length of the belt 12 will be greater in the expanded, or lengthened, condition than in the contracted, or shortened, condition. In the contracted condition, the belt 12 is adapted to be worn about the waist W of the user U, as seen in FIG. 2, with the connector members 14A, 14B connected to one another and the closed loops 28 formed by the releasably and reversably attachable flexible members 22, 24 being positioned on the same one side 12C of the belt 12 as the storage bag 16. In the expanded condition, the belt 12 is adapted to be worn across the front F of the torso T and over one shoulder S of the user U, as seen in FIGS. 4, 6 and 7, with the connector members 14A, 14B of the belt 12 disconnected from one another and the pair of closed loops 28 formed by the releasably and reversably attachable flexible members 22, 24 now being positioned on the opposite side 12D of the belt 12 from the storage bag 16 to encompass and hold and carry the pair of skis P in a generally upright orientation along the user's back R of the torso T. As shown in FIG. 7, one closed loop 28 extends about the skis P at a location below the bindings B of the skis P, whereas the other closed loop 28 extends about the skis P at a location nearer to but spaced from the front curved tips T of the skis P.

It will be observed that the storage bag 16 is accessible at the front of the user U both when the belt 12 is worn around waist W and across or along the front F of the torso T to carry the skis P. After being adjusted to the expanded condition, the intermediate portion of the belt 12 with the storage bag 16 attached thereto is disposed across or along the front F of the user's torso T so as to still provide convenient access by the user U to the storage bag 16.

To recapitulate, referring to FIG. 2, there is illustrated the user U with the accessory 10 converted to the single use storage belt mode, whereas referring to FIGS. 4, 6 and 7, there is illustrated a user with the accessory converted to the dual use storage belt and ski carrier mode. FIGS. 1 and 6 show the belt 12 and storage bag 16 of the accessory 10 disposed across the front F of the user's torso T. FIGS. 1 and 7 show the pair of skis P carried across the back R of the user's torso T. Thus, the combination storage belt and ski carrier accessory 10 is convertible between the single use storage belt mode, as shown in FIG. 2, and the dual use storage belt and ski carrier mode, as shown in FIGS. 4, 6 and 7. The accessory 10 is converted from the single use to dual use mode, first, by adjusting the length of the belt 12 from the contracted condition with the connector members 14A, 14B being connected to one another adapting the belt 12 to be worn about the user's waist W, to an expanded condition with the connector members 14A, 14B being disconnected from one another adapting the belt 12 to be worn across the front F of the torso T and over the shoulder S of the user U. In the contracted condition of the belt 12, the pairs of flexible members 22, 24 are formed into a pair of closed loops 28A disposed on the same one side 12C of the belt 12 as the storage bag 16 so as to not interfere with wearing of the belt 12 about the waist W of the user U. In the expanded condition of the belt 12, the pairs of flexible members 22, 24 are formed into a pair of closed loops 28B on the opposite side 12D of the belt 12 from the storage bag 16 so as to facilitate extending the loops 28B around the pair of skis P so as to hold and carry skis P in the generally upright orientation along the user's back R.

The belt 12 and straps 18 of the accessory are fabricated from relatively flexible but sturdy and inelastic material, such as commonly made from nylon, so that the accessory will have sufficient strength to hold the pair of skis P in a firm and reliable manner. The accessory 10 permits the user to carry the pair of skis P with his or her hands free to carry other items, such as ski poles and/or boots. Also, the storage bag 16 remains available and accessible at all times, whether while walking or skiing, for storing and retrieving various items.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A combination storage belt and ski carrier accessory, comprising:

(a) an elongated belt having a pair of connector members mounted to respective ones of a pair of opposite ends of said belt and being connectable to and disconnectable from one another;

(b) first and second means for releasably supporting a pair of skis from said belt, said first means being attached to said belt adjacent to one of said opposite ends thereof, said second means being attached to said belt adjacent to the other of said opposite ends thereof; and (c) a storage bag attached to said belt at an intermediate location thereon being spaced from said opposite ends of said belt;

(d) said belt including (i) a main strap portion having a pair of opposite ends, a first of said opposite ends of said main strap portion being fixedly attached to said storage bag and a second of said opposite ends of said main strap portion being secured to one of said first and second means for releasably supporting the pair of skis from said belt, (ii) an adjustment strap portion having a pair of opposite ends, a first of said opposite ends of said adjustment strap portion being secured to the other of said first and second means for releasably supporting the pair of skis from said belt, a second of said opposite ends of said adjustment strap portion being a free end, said adjustment strap portion intermediate of said first and second opposite ends thereof being mounted to said storage bag so as to undergo sliding movement in opposite directions relative to and past said storage bag and said first opposite end of said main strap portion, and (iii) an adjustment member fixedly attached to said main strap portion intermediate of said first and second opposite ends thereof, said adjustment member being adjustably coupled to said free second end of said adjustment strap portion so as to permit changing of the length of said adjustment strap portion extending from said adjustment member past said storage bag to said first opposite end of said adjustment strap and thereby to permit converting of said belt between a contracted condition and an expanded condition, said belt having an overall length greater in said expanded condition than in said contracted condition.

2. The accessory of claim 1 wherein said main strap portion is fixedly attached along said first opposite end thereof to a side of said storage bag so as to define a passage extending between said side of said storage bag and said first opposite end of said main strap portion, said adjustment strap portion intermediate of said first and second opposite ends thereof being mounted through said passage to undergo said sliding movement relative to said storage bag and said first opposite end of said main strap portion.

3. The accessory of claim 1 wherein said belt is adapted to be worn in two alternative modes.

4. The accessory of claim 3 wherein a first of said two alternative modes is a single use storage belt mode.

5. The accessory of claim 4 wherein said belt is in a contracted condition when in said single use storage belt mode.

6. The accessory of claim 4 wherein said pair of connector members are connected to one another when said belt is in said single use storage belt mode.

7. The accessory of claim 4 wherein a second of said two alternative modes is a dual use storage belt and ski carrier mode.

8. The accessory of claim 7 wherein said belt is in an expanded condition when in said dual use storage belt and ski carrier mode.

9. The accessory of claim 7 wherein said pair of connector members are disconnected from one another when said belt is in said dual use storage belt and ski carrier mode.

10. A combination storage belt and ski carrier accessory, comprising:

(a) an elongated belt having means mounted to a pair of opposite ends of the belt for releasably securing said opposite ends of said belt to one another;

(b) two pairs of flexible members for releasably supporting a pair of skis from said belt, a first of said pairs of flexible members being attached to said belt adjacent to one of said opposite ends thereof, a second of said pairs of flexible members being attached to said belt adjacent to the other of said opposite ends thereof, said flexible members of each pair thereof being releasably and reversably attachable to one another to form a closed loop being disposed on either one of a pair of opposite sides of said belt; and (c) a storage bag attached to said belt at an intermediate location thereon spaced from said opposite ends of said belt and on a predetermined one of said opposite sides of said belt;

(d) said belt including (i) a main strap portion having a pair of opposite ends, a first of said opposite ends of said main strap portion being fixedly attached to said storage bag and a second of said opposite ends of said main strap portion being secured to one of said first and second pairs of flexible members for releasably supporting the pair of skis from said belt, (ii) an adjustment strap portion having a pair of opposite ends, a first of said opposite ends of said adjustment strap portion being secured to the other of said first and second pairs of flexible members for releasably supporting the pair of skis from said belt, a second of said opposite ends of said adjustment strap portion being a free end, said adjustment strap portion intermediate of said first and second opposite ends thereof being mounted to said storage bag so as to undergo sliding movement in opposite directions relative to and past said storage bag and said first opposite end of said main strap portion, and (iii) an adjustment member fixedly attached to said main strap portion intermediate of said first and second opposite ends thereof, said adjustment member being adjustably coupled to said free second end of said adjustment strap portion so as to permit changing of the length of said adjustment strap portion extending from said adjustment member past said storage bag to said first opposite end of said adjustment strap and thereby to permit converting of said belt between a contracted condition and an expanded condition, said belt having an overall length greater in said expanded condition than in said contracted condition.

11. The accessory of claim 10 wherein said main strap portion is fixedly attached along said first opposite end thereof to a side of said storage bag so as to define a passage extending between said side of said storage bag and said first opposite end of said main strap portion, said adjustment strap portion intermediate of said first and second opposite ends thereof being mounted through said passage to undergo said sliding movement relative to said storage bag and said first opposite end of said main strap portion.

12. The accessory of claim 10 wherein said flexible members of each pair thereof has fastening means secured to each of a pair of opposite sides of each flexible member.

13. The accessory of claim 12 wherein said fastening means is complementary hook and loop fastening material.

14. The accessory of claim 10 wherein said releasable securing means on said belt is a pair of matable connector members mounted to said respective opposite ends of said belt being connectable to and disconnectable from one another.

15. The accessory of claim 14 wherein:

said belt is adapted to be worn in two alternative modes, a first of said two alternative modes being a single use storage belt mode wherein said connector members are connected to one another and said closed loops formed by said releasably and reversably attachable flexible members of said pairs thereof are positioned on the same one of said pair of opposite sides of said belt as said storage bag, a second of said two alternative modes being a dual use storage belt and ski carrier mode wherein said connector members are disconnected from one another and said closed loops formed by said releasably and reversably attachable flexible members of said pairs thereof are positioned on the opposite side of said belt from said storage bag.

* * * * *